US007913530B2

(12) United States Patent
Mishima

(10) Patent No.: US 7,913,530 B2
(45) Date of Patent: Mar. 29, 2011

(54) CLOSING METHOD AND CLOSING MACHINE

(75) Inventor: Keisuke Mishima, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 292 days.

(21) Appl. No.: 11/887,150

(22) PCT Filed: Mar. 30, 2006

(86) PCT No.: PCT/JP2006/307271

§ 371 (c)(1),
(2), (4) Date: Sep. 26, 2007

(87) PCT Pub. No.: WO2006/107092

PCT Pub. Date: Oct. 12, 2006

(65) Prior Publication Data

US 2009/0126437 A1 May 21, 2009

(30) Foreign Application Priority Data

Mar. 31, 2005 (JP) ..... 2005-101771

(51) Int. Cl.
*B21D 22/00* (2006.01)
*B21B 5/00* (2006.01)

(52) U.S. Cl. ..... 72/84; 72/80; 72/115

(58) Field of Classification Search ..... 72/84, 85, 72/112, 115, 125, 370.1, 370.12, 80, 82
See application file for complete search history.

(56) References Cited

U.S. PATENT DOCUMENTS

| | | | | |
|---|---|---|---|---|
| 4,541,266 | A * | 9/1985 | Totsu | 72/391.6 |
| 5,015,938 | A * | 5/1991 | Oehler et al. | 318/696 |
| 2001/0000285 | A1 * | 4/2001 | Tanaka | 192/45 |
| 2003/0154600 | A1 | 8/2003 | Umeda et al. | |

FOREIGN PATENT DOCUMENTS

| | | |
|---|---|---|
| JP | 2002-153930 | 5/2002 |
| JP | 2002-192277 | 7/2002 |
| JP | 2003-200241 | 7/2003 |
| JP | 2005-342725 | 12/2005 |

* cited by examiner

*Primary Examiner* — Dana Ross
*Assistant Examiner* — Debra M Sullivan
(74) *Attorney, Agent, or Firm* — Rabin & Berdo, PC

(57) ABSTRACT

A closing machine (1) for closing a work piece (9) by pressing a rotating die (4) against the rotating work piece (9) comprises a die support shaft (41) that supports the die (4), which is disposed coaxially with the work piece (9), rotatably, a power transmission mechanism (401) which transmits the torque of a motor 46 to the die support shaft (41) and a one-way clutch (410) which blocks torque that is input into the power transmission mechanism (401) from the die support shaft (41). During a closing operation, the die (4) is pressed against the work piece (9) so as to contact the work piece (9) slidingly such that the die (4) rotates in accordance with the work piece (9), which rotates at a higher speed than the die (4).

10 Claims, 7 Drawing Sheets

CLOSING METHOD AND CLOSING MACHINE

FIELD OF THE INVENTION

This invention relates to an improvement in a closing method and a closing machine for closing an open end of a metal pipe material.

BACKGROUND OF THE INVENTION

In a closing method, a work piece constituted by a metal pipe material is rotated and a die is pressed against the work piece while the work piece is heated. Thus, the work piece undergoes plastic deformation as it gradually approaches the die.

A closing machine used in the closing operation comprises an outer diameter chuck that grips an outer peripheral surface of the work piece, and a chuck spindle that drives the outer diameter chuck to rotate together with the work piece. The work piece is closed by pressing the rotating die against the work piece at an offset to the rotating work piece.

The closing method and closing machine described above are disclosed in JP2002- 153930A.

During a closing operation in a conventional closing machine, a die is pressed against a work piece so as to be brought into sliding contact therewith, and as a result, the die rotates in accordance with the work piece, which rotates at a higher speed than the die.

However, during a closing operation in this conventional closing machine, when the die accelerates to catch up with the work piece, the rotation of the die cannot catch up with the rotation of the work piece quickly due to the large inertial mass of a drive system that rotates together with the die, and as a result, a tact time increases. Herein, the tact time is defined as a time required for closing a single workpiece.

It is therefore an object of this invention to provide a closing method and a closing machine with which a rotating die can catch up with a rotating work piece quickly.

SUMMARY OF THE INVENTION

This invention provides a closing method for closing an open end of a work piece by pressing a rotating die against the work piece rotating about an axial center, characterized in that the die, which is disposed coaxially with the work piece, is supported rotatably by a die support shaft, a torque of a motor is transmitted to the die support shaft via a power transmission mechanism, a torque input into the power transmission mechanism from the die support shaft is blocked via a one-way clutch, and during closing operation, the die is pressed against the work piece so as to contact the work piece slidingly such that the die rotates in accordance with the work piece, which rotates at a higher speed than the die.

This invention also provides a closing machine for closing an open end of a work piece by pressing a rotating die against the work piece rotating about an axial center, characterized by a die support shaft that supports the die, which is disposed coaxially with the work piece, rotatably a power transmission mechanism which transmits a torque of a motor to the die support shaft and a one-way clutch which blocks a torque that is input into the power transmission mechanism from the die support shaft. During a closing operation, the die is pressed against the work piece so as to contact the work piece slidingly such that the die rotates in accordance with the work piece, which rotates at a higher speed than the die.

According to this invention, while the die accelerates to catch up with the work piece during a closing operation, the one-way clutch blocks torque transmission from the die support shaft to the power transmission mechanism, and therefore the die support shaft rotates freely relative to the power transmission mechanism, leading to a reduction in the inertial mass of a drive system that rotates together with the die. As a result, the rotation of the die catches up with the rotation of the work piece quickly, enabling a reduction in the tact time and an improvement in productivity.

DESCRIPTION OF THE PREFERRED EMBODIMENTS

This invention will now be described in further detail with reference to the attached drawings.

Figure 1:
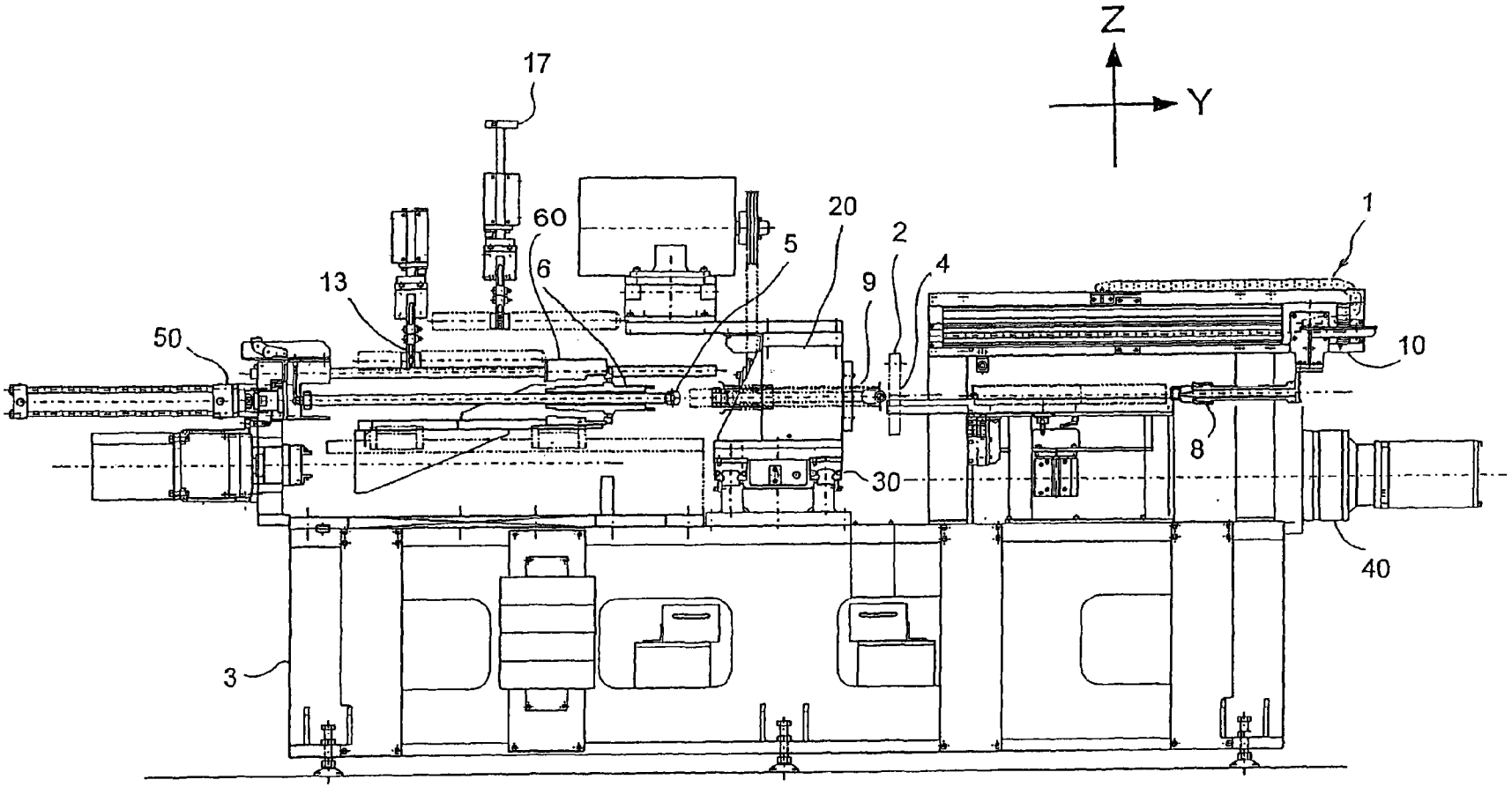
FIG. 1 is a side view of a closing machine, illustrating an embodiment of this invention.
Figure 2:
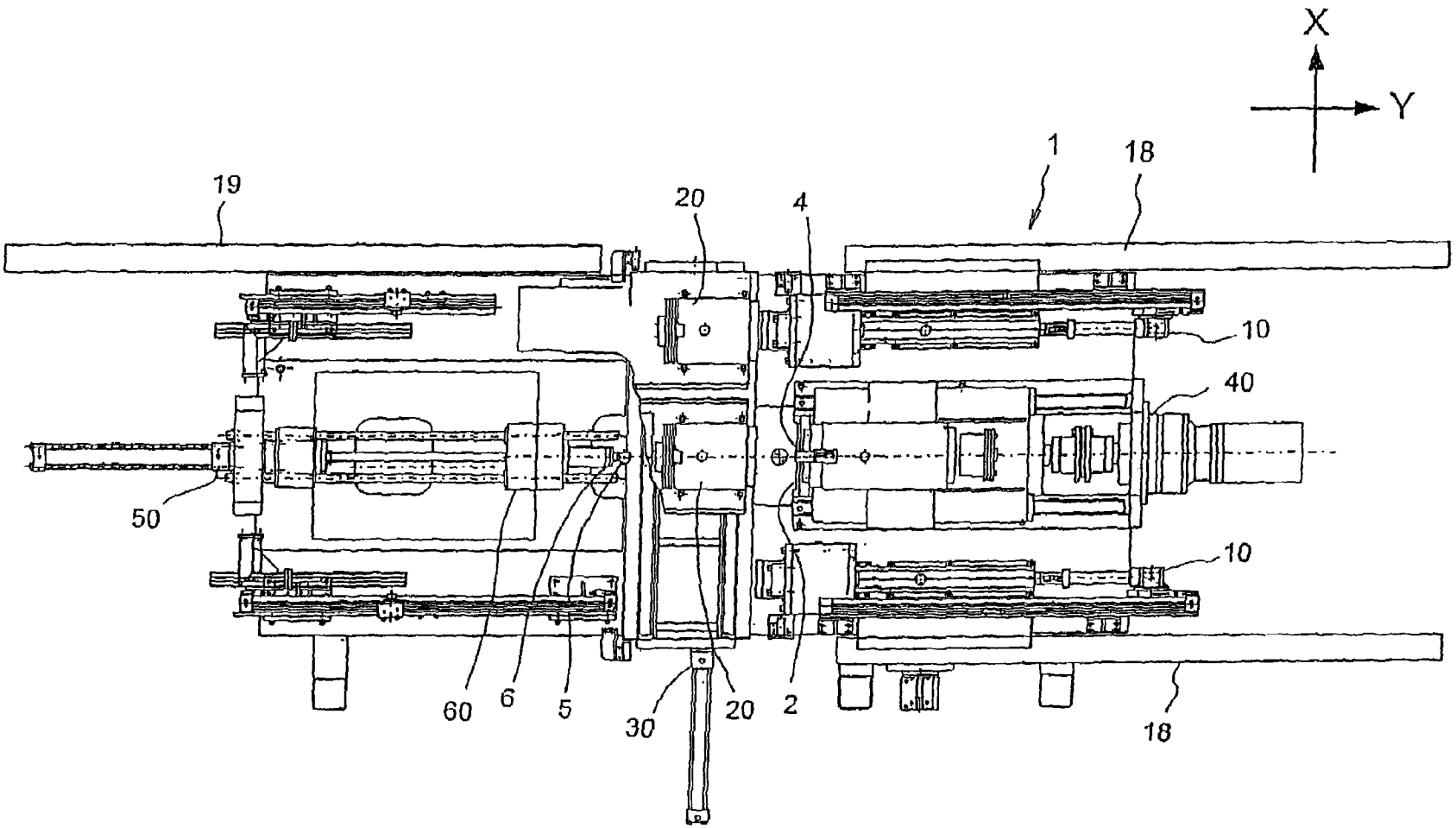
FIG. 2 is a plan view of the closing machine.
Figure 3:
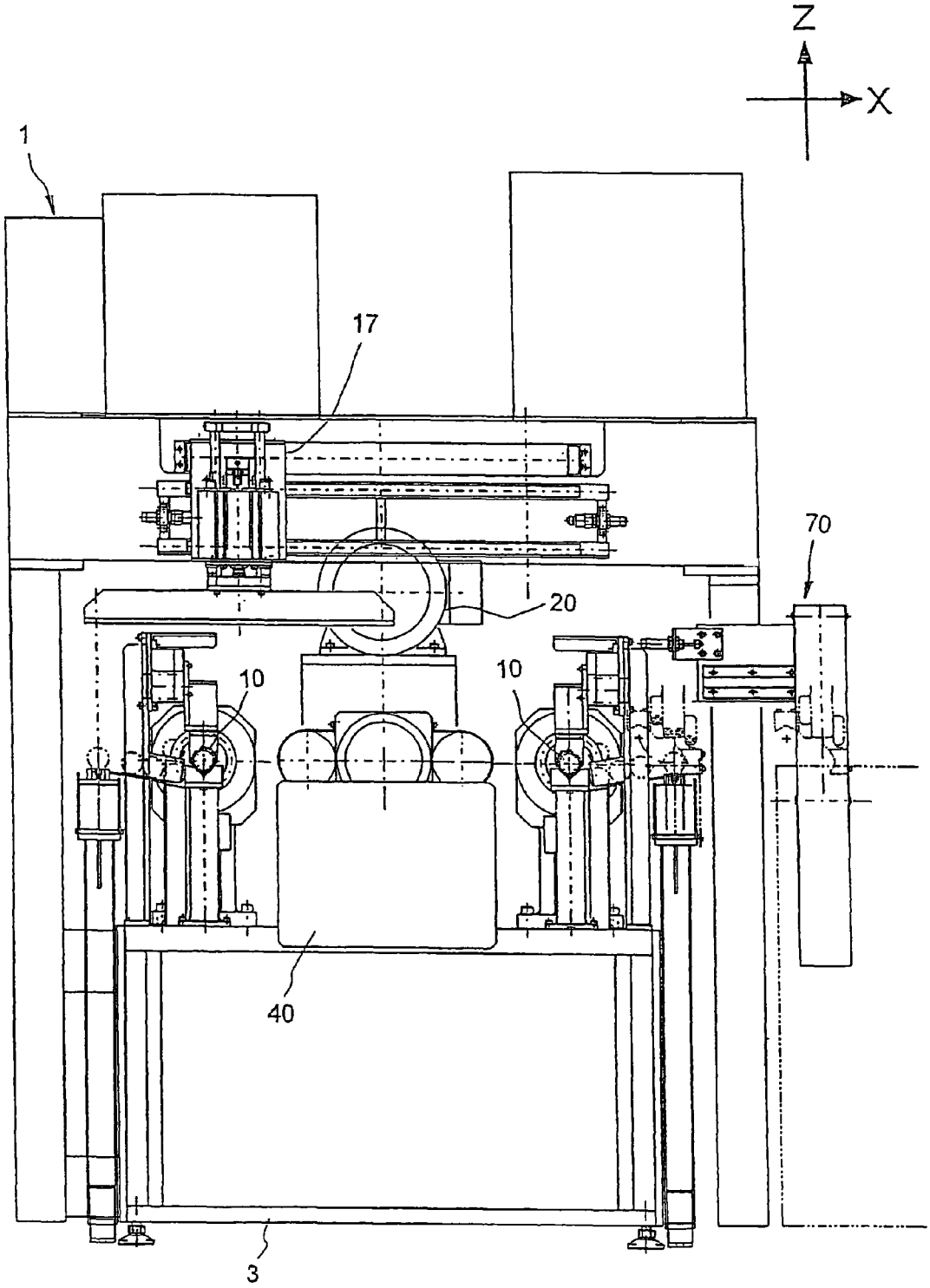
FIG. 3 is a front view of the closing machine.

FIGS. 1 to 3 show the overall constitution of a closing machine 1. In FIGS. 1 to 3, three axes, namely X, Y, and Z, are set orthogonal to each other. It is assumed that the X axis extends in a substantially horizontal lateral direction, the Y axis extends in a substantially horizontal front-rear direction, and the Z axis extends in a substantially vertical direction. The overall constitution of the closing machine 1 will now be described.

Two chuck spindles 20 which drive a work piece 9 to rotate about its axial center, and a single die driving device 40 which drives a die 4, are provided in a central portion of the closing machine 1. The chuck spindles 20 perform a reciprocating motion in the X axis direction relative to a pedestal 3 via a chuck spindle moving device 30, to be described later, thereby moving alternately to the central portion of the closing machine 1 so as to bring the work piece 9 face to face with the die 4.

The closing machine 1 performs a closing operation to close an open end of the work piece 9 by heating the work piece 9, which is constituted by a metal pipe material, using a high-frequency heating device 2, and pressing the die 4 against the rotating work piece 9 such that the work piece 9 undergoes plastic deformation.

A thrust stopper moving device 60, which is positioned in front of the chuck spindle 20 for closing the work piece 9 so as to support an end portion of the work piece 9, and a core moving device 50, which moves a core 5 inside the work piece 9, are provided in the central portion of the closing machine 1.

A pair of conveyors 18 and a work piece introducing device 10 are provided respectively on the left and right rear portions of the working machine 1. The work piece 9 is conveyed forward in the Y axis direction by each of the conveyors 18 and then conveyed forward in the Y axis direction by each of the work piece introducing devices 10, which are capable of movement in the Y axis direction. Thus, the work piece 9 is introduced into and gripped by the respective left and right chuck spindles 20.

While one of the chuck spindles 20 is positioned in the central portion of the working machine 1 during a closing operation, the other chuck spindle 20 is positioned on either the left or right end portion of the closing machine 1 so as to receive the work piece 9 conveyed by the respective work piece introducing devices 10.

A discharge device 17 for discharging the work piece 9 following the closing operation is provided at the front portion of the closing machine 1. The discharge device 17 causes a hand 13 gripping the work piece 9 to reciprocate in the X axis direction relative to the pedestal 3 such that the work piece 9, which is pushed out from the left and right chuck spindles 20, is conveyed to a conveyor 19 disposed on the right-hand front portion of the closing machine 1.

Once the closing operation is complete, the work piece 9, which is at a high temperature of 1000° C. or more, is conveyed to a cooling device 70 (see FIG. 3) by the conveyor 19 and cooled by the cooling device 70. The cooling device 70 is provided on the front right side of the closing machine 1.

FIGS. 4A to 4G show a series of processes performed by the closing machine 1 to close the work piece 9. Each process of this closing method will now be described in sequence.

Figure 4A:
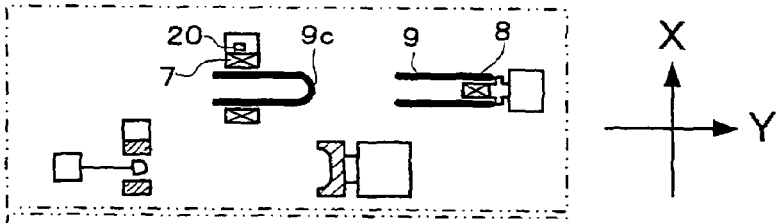
FIGS. 4A-4H are views showing closing processes.

Referring to FIG. 4A, an inner diameter chuck 8 of the work piece introducing device 10 is inserted into the work piece 9 such that the inner diameter chuck 8 grips the inner peripheral surface of the work piece 9.

Figure 4B:
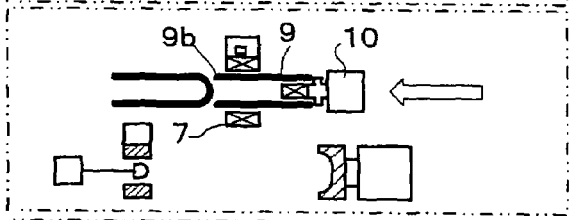

Referring to FIG. 4B, the work piece introducing device 10 causes the inner diameter chuck 8 to advance in the Y axis direction such that the work piece 9 is inserted into an outer diameter chuck 7 of the chuck spindle 20. Thus, the outer diameter chuck 7 grips the outer peripheral surface of the work piece 9.

Figure 4C:
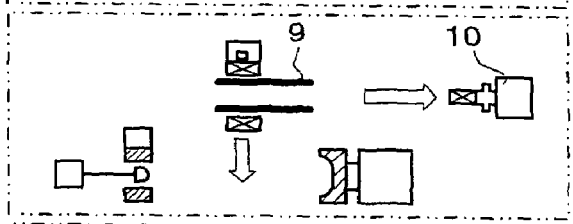

Referring to FIG. 4C, the work piece introducing device 10 causes the inner diameter chuck 8 to retreat in the Y axis direction such that the inner diameter chuck 8 is extracted from the work piece 9. Next, the chuck spindle moving device 30 moves the chuck spindle 20 in the X axis direction until the work piece 9 is stopped in an operation position facing the die 4.

Figure 4D:
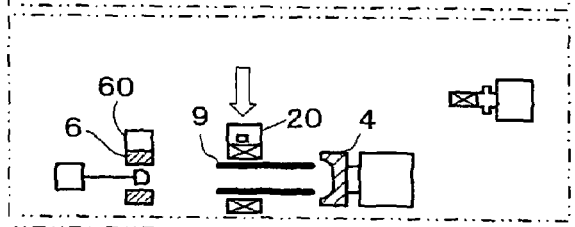

Referring to FIG. 4D, the thrust stopper moving device 60 moves a thrust stopper 6 to a thrust operation reference position supporting a base end portion 9*b* of the work piece 9.

Figure 4E:
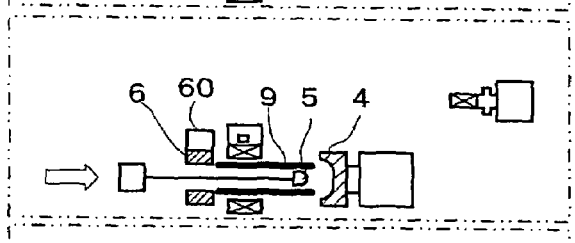

Referring to FIG. 4E, the core moving device 50 introduces the core 5 into the inside of the work piece 9.

Figure 4F:
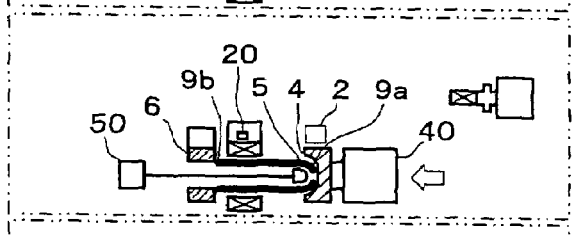

Referring to FIG. 4F, the chuck spindle 20 drives the work piece 9 and the core 5 to rotate. Meanwhile, the die 4 is pressed against the heated work piece 9 by the die driving device 40. Thus, a tip end portion 9*a* of the work piece 9 is steadily reduced in diameter between the die 4 and the core 5 such that finally, the tip end portion 9*a* of the work piece 9 closes to form a bottom portion 9*c*.

Figure 4G:
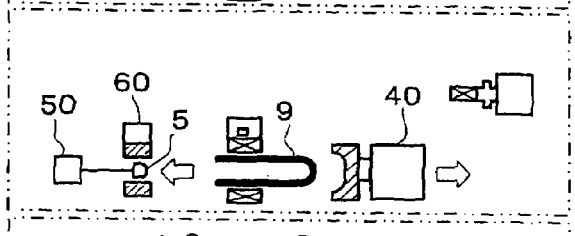

Referring to FIG. 4G, the die driving device 40 moves the die 4 rearward in the Y axis direction away from the work piece 9. Meanwhile, the thrust stopper moving device 60 moves the thrust stopper 6 forward in the Y axis direction away from the thrust operation reference position, and the core moving device 50 removes the core 5 from the inside of the work piece 9.

To close another work piece 9 thereafter, the chuck spindle moving device 30 moves the chuck spindle 20 in the X axis direction such that the work piece 9 faces the inner diameter chuck 8, as shown in FIG. 4A. Then, as shown in FIG, 4B, the work piece introducing device 10 causes the inner diameter chuck 8 to advance in the Y axis direction such that the base end portion 9*b* of the unclosed work piece 9 abuts against the bottom portion 9*c* of the closed work piece 9, and thus the closed work piece 9 is pushed out of the outer diameter chuck 7.

Figure 4H:
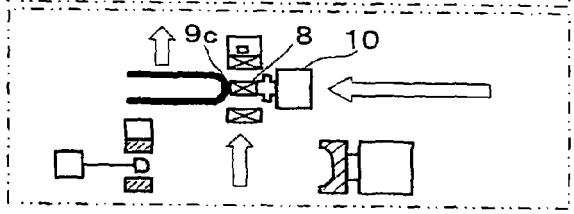

To terminate the closing operation of the work piece 9, the work piece introducing device 10 causes the inner diameter chuck 8 to advance in the Y axis direction, as shown in FIG. 4H, such that the inner diameter chuck 8 abuts against the bottom portion 9*c* of the closed work piece 9, and thus the closed work piece 9 is pushed out of the outer diameter chuck 7.

The overall constitution of the closing machine 1 was described above.

Figure 5:
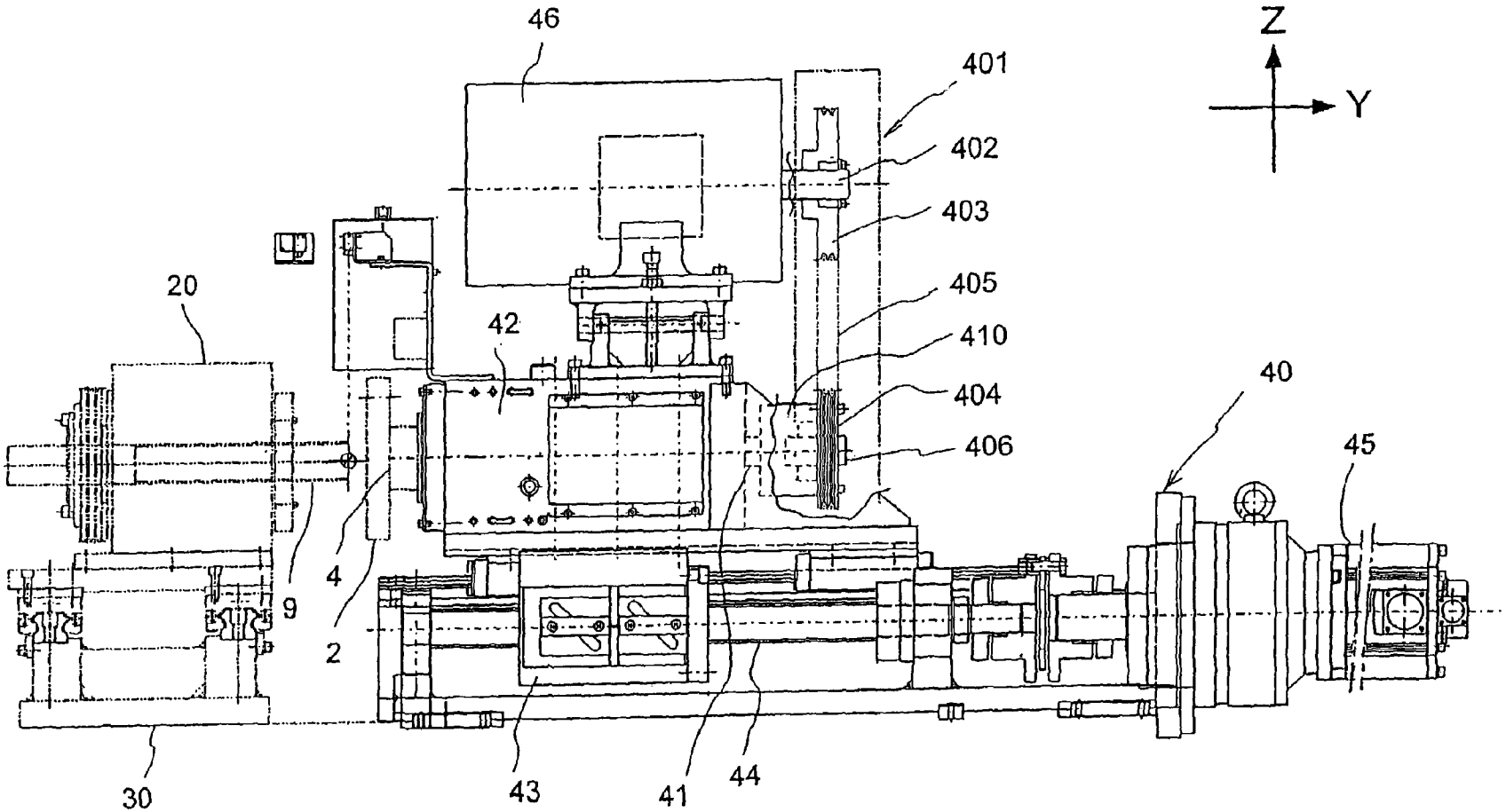
FIG. 5 is a side view of a die driving device.
Figure 6:
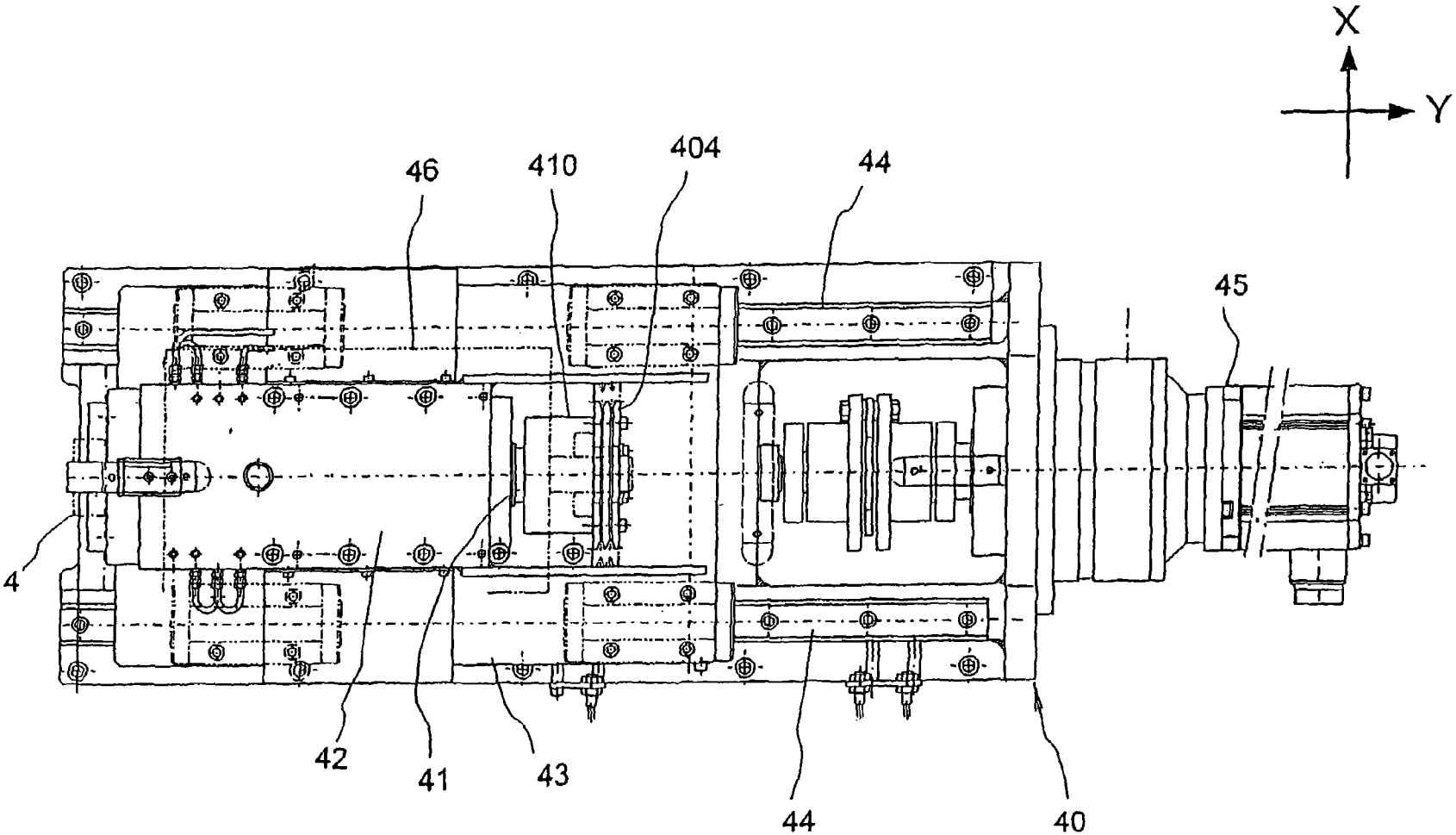
FIG. 6 is a plan view of the die driving device.
Figure 7:
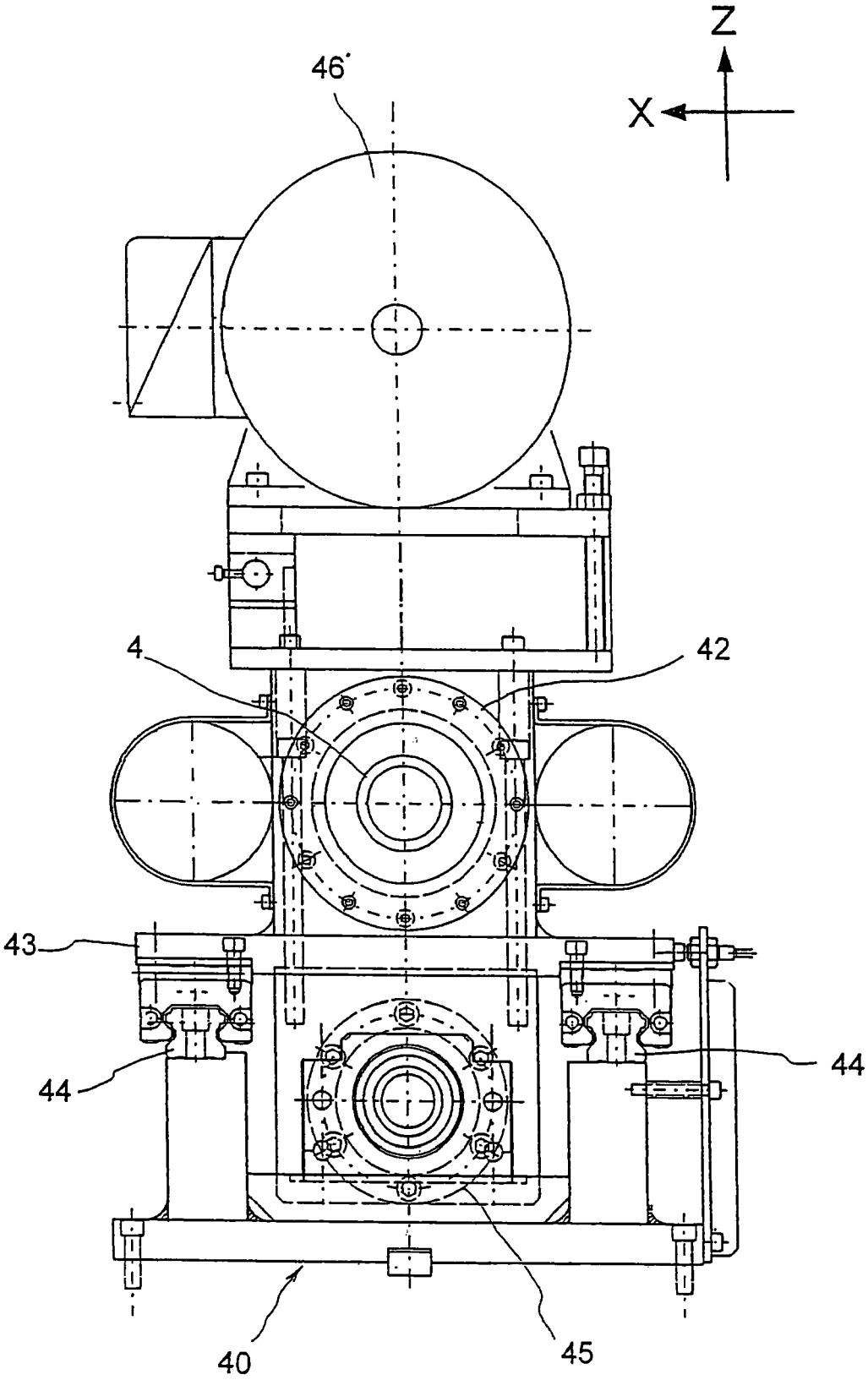
FIG. 7 is a front view of the die driving device.

Next, the constitution of the die driving device 40 shown in FIGS. 5 to 7 will be described.

The die driving device 40 comprises a die support shaft 41, the die 4 being attached to a front end portion thereof, a die support case 42 which supports the die support shaft 41 rotatably via a bearing not shown in the figure, two guide rails 44 which support a sliding table 43 carrying the die support case 42 movably in the Y axis direction, and a hydraulic cylinder 45 which drives the sliding table 43 in the Y axis direction. The hydraulic cylinder 45 moves the die support case 42 forward in the Y axis direction during a closing operation in accordance with the output of a controller, not shown in the figure, such that the die 4 is pressed against the work piece 9.

The die driving device 40 comprises the die support shaft 41 which supports the die 4 rotatably, a power transmission mechanism 401 which transmits the rotation of a motor 46 to the die support shaft 41, and a one-way clutch 410 which inputs torque from the power transmission mechanism 401 to the die support shaft 41 while blocking torque input from the die support shaft 41 to the power transmission mechanism 401.

The one-way clutch 410 has a rotation transmission mechanism which transmits torque from the motor 46 to the die support shaft 41 but blocks torque transmission from the die support shaft 41 to the motor 46.

The power transmission mechanism 401 comprises a pulley 403 connected to an output shaft 402 of the motor 46, a pulley 404 connected to the die support shaft 41 side, and a belt 405 wrapped around the two pulleys 403, 404.

The one-way clutch 410 is interposed between the die support shaft 41 and an output shaft 406 of the power transmission mechanism 401, and serves to block torque transmission from the die support shaft 41 to the output shaft 406 of the power transmission mechanism 401.

One end of the output shaft 406 of the power transmission mechanism 401 constitutes the one-way clutch 410, and the pulley 404 is connected to the other end.

In a process performed prior to a closing operation, the motor 46 drives the die 4 to rotate via the one-way clutch 410 and drives the work piece 9 to rotate via the chuck spindle 20. The rotation speed of the die 4 is set to be slightly lower than the rotation speed of the work piece 9.

During the closing operation, the die 4 is pressed against the work piece 9 so as to contact the work piece 9 slidingly. As a result, the die 4 catches up with the work piece 9, which rotates at a higher speed than the die 4, such that the die 4 and work piece 9 rotate at a substantially identical speed.

While the die 4 accelerates to catch up with the work piece 9, the one-way clutch 410 blocks torque transmission from the die support shaft 41 to the output shaft 406 of the power transmission mechanism 401. Thus, the output shaft 406 of the power transmission mechanism 401 is cut off from the die support shaft 41 via the one-way clutch 410, and therefore the die support shaft 41 rotates freely relative to the output shaft 406 of the power transmission mechanism 401, leading to a reduction in the inertial mass of the drive system that rotates together with the die 4. As a result, the rotation of the die 4 catches up with the rotation of the work piece 9 quickly, enabling a reduction in the tact time required to close a single work piece 9 and an improvement in productivity.

On the other hand, in a case where the one-way clutch 410 is interposed between the output shaft 402 of the motor 46 and the pulley 404 of the power transmission mechanism 401, the die support shaft 41 rotates together with the pulley 403 of the power transmission mechanism 401, causing the belt 405 to revolve, and therefore, even if the one-way clutch 410 blocks torque transmission from the die support shaft 41 to the motor 46 while the die 4 accelerates to catch up with the work piece 9, the rotation of the die 4 catches up with the rotation of the work piece 9 slowly due to the large inertial mass of the drive system that rotates together with the die 4, and as a result, the tact time increases.

It should be noted that the power transmission mechanism 401 for transmitting the rotation of the motor 46 to the die support shaft 41 is not limited to a constitution comprising the pulleys 403, 404 and the belt 405, and may employ gears or another mechanism, for example.

INDUSTRIAL APPLICABILITY

The closing method and closing machine of this invention are not limited to a closing operation such as that described above, for closing an open end of a work piece, and may be used in a spinning operation to reduce the diameter of a work piece by pressing a die against the rotating work piece.

The invention claimed is:

1. A closing method for closing an open end of a work piece, comprising:

supporting a die in a rotatable state coaxially with the work piece by a die support shaft;

transmitting a torque of a motor to the die support shaft via a power transmission mechanism;

blocking a torque from being input into the power transmission mechanism from the die support shaft while simultaneously allowing a torque to be input into the die support shaft from the power transmission mechanism, using a one-way clutch; and pressing the die against the work piece during a closing operation so as to slidingly contact the work piece, such that the die rotates in accordance with the work piece, which initially rotates at a higher speed than the die.

2. The closing method recited in claim 1, wherein the die is coaxially rotatable with the work piece.

3. The closing method recited in claim 1, wherein during said pressing, a rotational speed of the die increases until it reaches substantially a same rotational speed of the work piece.

4. The closing method recited in claim 3, wherein as the rotational speed of the die increases, the one-way clutch allows the die support shaft to freely rotate relative to the power transmission mechanism.

5. The closing method recited in claim 4, wherein the power transmission mechanism includes an output shaft, and wherein the one-way clutch is disposed between the output shaft and the die support shaft.

6. A closing machine for closing an open end of a work piece, comprising:

a die which rotates;

a die support shaft that supports the die in a rotatable state coaxially with the work piece;

a power transmission mechanism which transmits a torque of a motor to the die support shaft; and a one-way clutch which blocks a torque from the die support shaft from being input into the power transmission mechanism, while simultaneously allowing the torque from the power transmission mechanism to be input into the die support shaft;

wherein the die is pressed against the work piece so as to slidingly contact the work piece such that the die rotates in accordance with the work piece, which initially rotates at a higher speed than the die.

7. The closing machine recited in claim 6, wherein the die is coaxially rotatable with the work piece.

8. The closing machine recited in claim 6, wherein as the die is pressed against the work piece, a rotational speed of the die increases until it reaches substantially a same rotational speed of the work piece.

9. The closing machine recited in claim 8, wherein as the rotational speed of the die increases, the one-way clutch allows the die support shaft to freely rotate relative to the power transmission mechanism.

10. The closing machine recited in claim 9, wherein the power transmission mechanism includes an output shaft, and wherein the one-way clutch is disposed between the output shaft and the die support shaft.

* * * * *